US011465882B2

(12) United States Patent
Shi

(10) Patent No.: US 11,465,882 B2
(45) Date of Patent: Oct. 11, 2022

(54) OVERSPEED PROTECTION SWITCH, OVERSPEED GOVERNOR ASSEMBLY AND ELEVATOR SYSTEM

(71) Applicant: Otis Elevator Company, Farmington, CT (US)

(72) Inventor: Zhengbao Shi, Shanghai (CN)

(73) Assignee: OTIS ELEVATOR COMPANY, Farmington, CT (US)

( * ) Notice: Subject to any disclaimer, the term of this patent is extended or adjusted under 35 U.S.C. 154(b) by 401 days.

(21) Appl. No.: 16/581,881

(22) Filed: Sep. 25, 2019

(65) Prior Publication Data

US 2020/0102190 A1 Apr. 2, 2020

(30) Foreign Application Priority Data

Sep. 29, 2018 (CN) ..... 201811147086.5

(51) Int. Cl.

| | |
|---|---|
| ***B66B 5/04*** | (2006.01) |
| ***B66B 1/26*** | (2006.01) |
| ***B66B 1/32*** | (2006.01) |

(52) U.S. Cl.

CPC ..... *B66B 5/044* (2013.01); *B66B 1/26* (2013.01); *B66B 1/32* (2013.01)

(58) Field of Classification Search

CPC .. B66B 5/044; B66B 1/26; B66B 1/32; B66B 5/046

See application file for complete search history.

(56) References Cited

U.S. PATENT DOCUMENTS

| | | | |
|---|---|---|---|
| 4,986,734 | A | 1/1991 | Layer et al. |
| 5,565,660 | A | 10/1996 | Karner |
| 5,630,483 | A | 5/1997 | Karner |

(Continued)

FOREIGN PATENT DOCUMENTS

| | | | |
|---|---|---|---|
| BE | 814690 | A | 11/1974 |
| CN | 2786769 | Y | 6/2006 |

(Continued)

OTHER PUBLICATIONS

Machine translation of CN 111874773.*

(Continued)

*Primary Examiner* — Diem M Tran

(74) *Attorney, Agent, or Firm* — Cantor Colburn LLP

(57) ABSTRACT

An overspeed protection switch, an overspeed governor assembly and an elevator system are provided. The overspeed protection switch includes: a trigger member, which is in an untriggered position when the overspeed governor assembly is in normal operation, and which is capable of rotating to a triggered position from the untriggered position when being toggled by a centrifugal mechanism of the overspeed governor assembly in case of overspeed of the overspeed governor assembly; at least one protrusion connected to the trigger member and rotating together with the trigger member; a reset lever which is rotatable along an axial axis from an idle position to act on one of the at least one protrusion to drive the trigger member to return to the untriggered position from the triggered position; and an actuation device which, in response to a reset command, acts on the reset lever to rotate the reset lever.

20 Claims, 10 Drawing Sheets

(56) References Cited

U.S. PATENT DOCUMENTS

| | | | |
|---|---|---|---|
| 6,186,281 | B1 | 2/2001 | Pietrzykowski et al. |
| 6,765,163 | B2 | 7/2004 | Aguado et al. |
| 8,939,262 | B2 | 1/2015 | Schienda et al. |
| 9,708,157 | B2 | 7/2017 | Porta et al. |
| 9,975,731 | B2 | 5/2018 | Osmanbasic et al. |
| 2013/0098711 | A1 | 4/2013 | Aguado et al. |
| 2017/0190545 | A1 | 7/2017 | Dube et al. |
| 2018/0118515 | A1 | 5/2018 | Shi et al. |
| 2019/0127179 | A1* | 5/2019 | Shi ..... H01F 7/123 |

FOREIGN PATENT DOCUMENTS

| | | | | |
|---|---|---|---|---|
| CN | 1290129 | C | | 12/2006 |
| CN | 100404404 | C | | 7/2008 |
| CN | 101172552 | B | | 5/2011 |
| CN | 104080722 | B | | 11/2015 |
| CN | 104016205 | B | | 8/2016 |
| CN | 104837757 | B | | 12/2016 |
| CN | 106516931 | A | | 3/2017 |
| CN | 107777503 | A | | 3/2018 |
| CN | 108423512 | A | | 8/2018 |
| CN | 109516335 | A | * | 3/2019 |
| CN | 111874773 | A | * | 11/2020 |
| JP | 2015067378 | A | | 4/2015 |
| JP | 5870165 | B2 | | 2/2016 |
| KR | 20180081351 | A | | 7/2018 |

OTHER PUBLICATIONS

European Search Report for application EP 19200627.8, dated Feb. 25, 2020, 14 pages.

Indian Examination Report for Application No. 201914036263; dated May 6, 2021; 5 Pages.

* cited by examiner

OVERSPEED PROTECTION SWITCH, OVERSPEED GOVERNOR ASSEMBLY AND ELEVATOR SYSTEM

FOREIGN PRIORITY

This application claims priority to Chinese Patent Application No. 201811147086.5, filed Sep. 29, 2018, and all the benefits accruing therefrom under 35 U.S.C. § 119, the contents of which in its entirety are herein incorporated by reference.

FIELD OF THE INVENTION

The present disclosure relates to the field of elevator safety, and in particular to an overspeed governor assembly for an elevator and an elevator having such overspeed governor assembly.

BACKGROUND OF THE INVENTION

With the development of overspeed governor assembly technology for elevator, a new Car-Mounted Governor (CMG) assembly has received wider application. The car-mounted overspeed governor assembly is more compact in structure, as compared to conventional overspeed governor assemblies with or without a machine room. An overspeed governor assembly is disclosed by Aguado et al., in U.S. Patent Publication No. US 2013/0098711A1 published on Apr. 25, 2013, wherein the overspeed governor assembly incudes a centrifugal mechanism which is gradually deployed as a rotational speed of a rope sheave increases. When the rope sheave reaches a first speed, an outer side of the centrifugal mechanism toggles an overspeed protection switch, thereby braking and halting the elevator through an electrical mechanism. If the speed of the rope sheave continues to increase to a second speed, the centrifugal mechanism will drive a core ring on the inner side thereof, thereby triggering a mechanical brake device.

After the car brakes and the maintenance on the elevator is completed, the overspeed protection switch needs to be returned to an untriggered position so that the elevator can run again and protection can be provided when overspeed occurs for the next time.

SUMMARY OF THE INVENTION

An object of the present disclosure to solve or at least alleviate the problems in the prior art.

In one aspect, an overspeed protection switch for an overspeed governor assembly is provided, the overspeed protection switch having a portion that provides a self-reset function, and the overspeed protection switch including: a trigger member, which is in an untriggered position when the overspeed governor assembly is in normal operation, and which is capable of rotating to a triggered position from the untriggered position when being toggled by a centrifugal mechanism of the overspeed governor assembly in case of overspeed of the overspeed governor assembly; at least one protrusion connected to the trigger member and rotating together with the trigger member; a reset lever which is rotatable along an axial axis from an idle position to act on one of the at least one protrusion to drive the trigger member to return to the untriggered position from the triggered position; and an actuation device which, in response to a reset command, acts on the reset lever to rotate the reset lever.

Optionally, in the overspeed protection switch, when in the untriggered position, the trigger member is capable of rotating to a first triggered position in a first direction or rotating to a second triggered position in a second direction, depending on a rotational direction of the centrifugal mechanism.

Optionally, in the overspeed protection switch, the at least one protrusion includes a first protrusion and a second protrusion, wherein in the first triggered position, the reset lever contacts the first protrusion and drives the trigger member to return to the untriggered position from the first triggered position, and in the second triggered position, the reset lever contacts the second protrusion and drives the trigger member to return to the untriggered position from the second triggered position.

Optionally, in the overspeed protection switch, the trigger member has an outer end and an inner end, the inner end of the trigger member is connected to a rotating frame, and the first protrusion and the second protrusion are arranged on the rotating frame.

Optionally, in the overspeed protection switch, when the trigger member returns to the untriggered position, the reset lever contacts the first protrusion and the second protrusion simultaneously, and after the trigger member returns to the untriggered position, the reset lever returns to the idle position.

Optionally, in the overspeed protection switch, the actuation device includes: an actuator having an action end capable of performing a linear reciprocating movement; a link mechanism, via which the actuator is connected to a pivot shaft; and the pivot shaft connected to the reset lever, wherein the pivot shaft rotates when driven by the actuator so as to drive the reset lever to rotate.

Optionally, in the overspeed protection switch, the pivot shaft is fitted into a mounting hole of a limiting member, and the limiting member is connected to a fixed bracket.

Optionally, in the overspeed protection switch, the link mechanism includes: a first link, a first end of the first link being pivotally connected to the action end of the actuator, and a second end of the first link being pivotally connected to a first end of a second link; and the second link, a second end of the second link being drivingly connected to the pivot shaft.

Optionally, in the overspeed protection switch, the action end of the actuator, the first link and the second link move in a first plane, the reset lever moves in a second plane, the pivot shaft extends from the first plane to the second plane, the first plane is closer to a base surface of the fixed bracket than the second plane, and the first plane and the second plane are parallel with each other.

Optionally, in the overspeed protection switch, the trigger member is located between the first plane and the second plane, and the at least one protrusion extends to the second plane.

In another aspect, an overspeed governor assembly is provided, which includes: a rope sheave; a centrifugal mechanism mounted on the rope sheave and rotating together with the rope sheave; and an overspeed protection switch radially outward of the centrifugal mechanism by a certain distance, the overspeed protection switch including: a trigger member, which is in an untriggered position when the overspeed governor assembly is in normal operation, and which is capable of rotating to a triggered position from the untriggered position when being toggled by the centrifugal mechanism of the overspeed governor assembly in case of overspeed of the overspeed governor assembly; at least one protrusion connected to the trigger member and rotating together with the trigger member; a reset lever which is rotatable along an axial axis from an idle position to act on one of the at least one protrusion to drive the trigger member to return to the untriggered position from the triggered position; and an actuation device which, in response to a reset command, acts on the reset lever to rotate the reset lever.

Optionally, in the overspeed governor assembly, when in the untriggered position, the trigger member is capable of rotating to a first triggered position in a first direction or rotating to a second triggered position in a second direction, depending on a rotational direction of the centrifugal mechanism.

Optionally, in the overspeed governor assembly, the at least one protrusion includes a first protrusion and a second protrusion, wherein in the first triggered position, the reset lever contacts the first protrusion and drives the trigger member to return to the untriggered position from the first triggered position, and in the second triggered position, the reset lever contacts the second protrusion and drives the trigger member to return to the untriggered position from the second triggered position.

Optionally, in the overspeed governor assembly, the trigger member has an outer end and an inner end, the inner end of the trigger member is connected to a rotating frame, and the first protrusion and the second protrusion are arranged on the rotating frame.

Optionally, in the overspeed governor assembly, when the trigger member returns to the untriggered position, the reset lever contacts the first protrusion and the second protrusion simultaneously, and after the trigger member returns to the untriggered position, the reset lever returns to the idle position.

Optionally, in the overspeed governor assembly, the actuation device includes: an actuator having an action end capable of performing a linear reciprocating movement; a link mechanism, via which the actuator is connected to a pivot shaft; and the pivot shaft connected to the reset lever, wherein the pivot shaft rotates when driven by the actuator so as to drive the reset lever to rotate.

Optionally, in the overspeed governor assembly, the pivot shaft is fitted into a mounting hole of a limiting member, and the limiting member is connected to a fixed bracket.

Optionally, in the overspeed governor assembly, the link mechanism includes: a first link, a first end of the first link being pivotally connected to the action end of the actuator, and a second end of the first link being pivotally connected to a first end of a second link; and the second link, a second end of the second link being drivingly connected to the pivot shaft.

Optionally, in the overspeed governor assembly, the action end of the actuator, the first link and the second link move in a first plane, the reset lever moves in a second plane, the pivot shaft extends from the first plane to the second plane, the first plane is closer to a base surface of the fixed bracket than the second plane, and the first plane and the second plane are parallel with each other.

Optionally, in the overspeed governor assembly, the trigger member is located between the first plane and the second plane, and the at least one protrusion extends to the second plane.

Optionally, the overspeed governor assembly is a car-mounted overspeed governor assembly.

In another aspect, an elevator system is provided, which includes the overspeed governor assembly according to embodiments of the present disclosure.

The overspeed protection switch according to embodiments of the present disclosure has a simple structure, has less thrust requirement for the actuation device, has low cost or is convenient to operate.

BRIEF DESCRIPTION OF THE DRAWINGS

The contents of the present disclosure will become more easily understood with reference to the accompanying drawings. Those skilled in the art can readily appreciate that the drawings are for illustrative purposes only, instead of being intended to limit the scope of protection of the present disclosure. In addition, similar numbers in the drawings are used to indicate similar parts, wherein.

DETAILED DESCRIPTION OF THE EMBODIMENT(S) OF THE INVENTION

It will be readily understood that, based on the technical solutions of the present disclosure, those skilled in the art can propose various alternative embodiments and implementations without departing from the true spirit of the present disclosure. Therefore, the following detailed description and the accompanying drawings are merely exemplary description of the technical solutions of the present disclosure, which shall not be deemed as the whole of the present disclosure or as limiting or restricting the technical solutions of the present disclosure.

Such orientation terms as upper, lower, left, right, front, rear, front side, back side, top, bottom or the like that are mentioned or may be mentioned in this description are defined with respect to the configurations shown in the individual drawings. They are relative concepts and thus possibly vary according to their different locations and different usage states. Therefore, these or other orientation terms shall not be interpreted as limiting terms.

Figure 1:
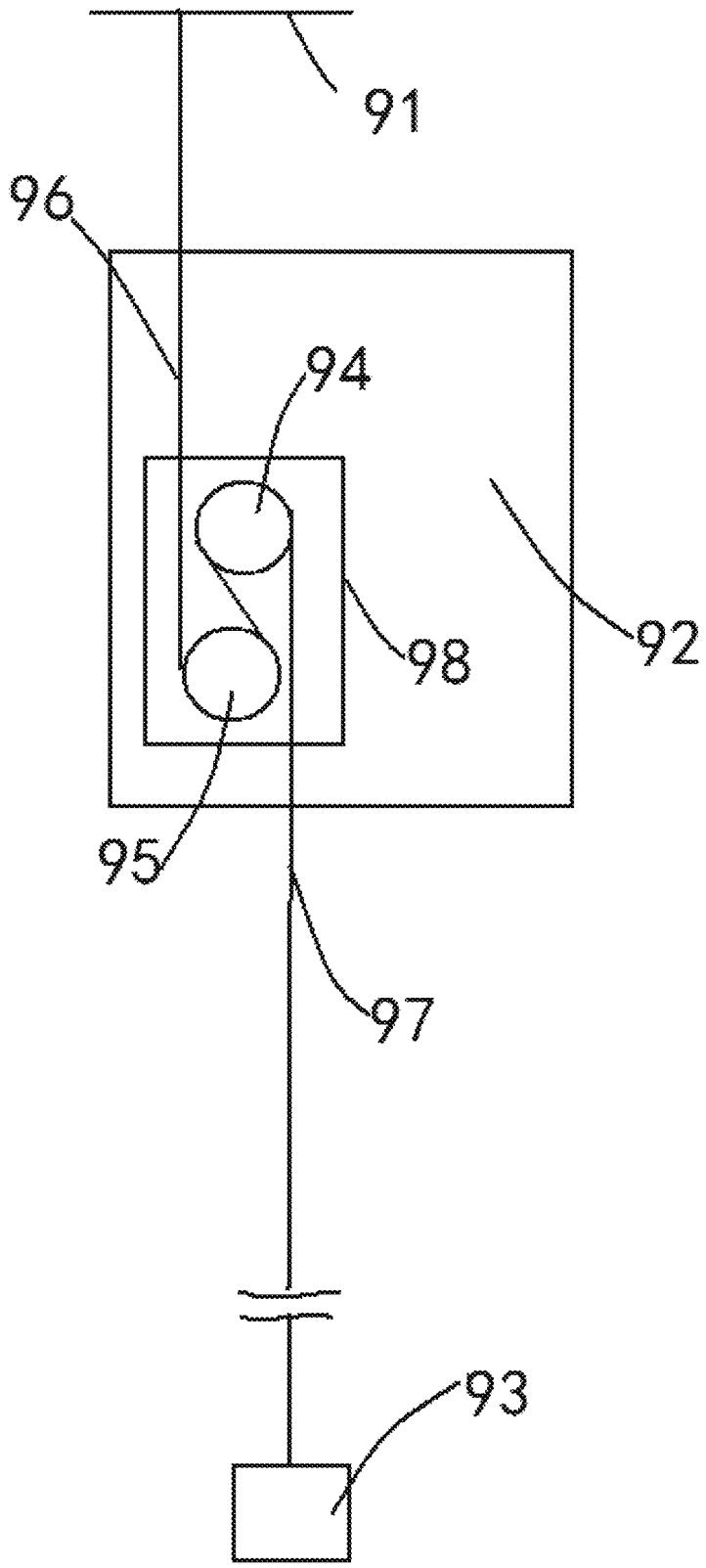
FIG. 1 shows a schematic view of an elevator system having a car-mounted overspeed governor.

First, referring to FIG. 1, an elevator system having a car-mounted overspeed governor assembly is illustrated. It should be understood that although a car-mounted overspeed governor assembly is described in various embodiments of the present disclosure, a core ring assembly of the present disclosure can be used in various types of overspeed governors, without being limited to those shown in the various views or embodiments. A car 92 is shown in FIG. 1, with an overspeed governor assembly 98 mounted thereon. For a typical overspeed governor assembly 98, reference may be made to US Patent Publication No. US20130098711A1 with the publication date of Apr. 25, 2013 and the applicant of Otis Elevator Company, which is incorporated herein by reference in its entirety. The overspeed governor assembly 98 includes a guide sheave 95 and a governor rope sheave 94. A rope suspended from a hoistway top 91 wraps around the guide sheave 95 and the governor rope sheave 94. The rope has a rope portion 96 upstream of the overspeed governor and a rope portion 97 downstream of the overspeed governor. The length of the rope portion 96 upstream of the overspeed governor and the length of the rope portion 97 downstream of the overspeed governor change constantly during the ascending or descending of the car. At the bottom of the hoistway, a bottom end of the rope portion 97 downstream of the overspeed governor is suspended with a weight 93 or is connected to a pulling device which provides a tension for the rope. During the ascending or descending of the car 92, the guide sheave 95 and the governor rope sheave 94 will rotate due to friction with the rope. A linear speed of a pitch circle rotation of the governor rope sheave 94 is consistent with a car running speed. When the ascending or descending speed of the elevator car exceeds a critical value, a centrifugal mechanism associated with the governor rope sheave 94 triggers an electrical brake device since a rotational speed of the rope sheave exceeds a first speed, cuts off power supply from an elevator drive motor, and brakes a drive sprocket, and when the rotational speed of the rope sheave exceeds a second speed greater than the first speed, the centrifugal mechanism triggers a mechanical brake device to brake the elevator car by friction with a guide rail.

Figure 2:
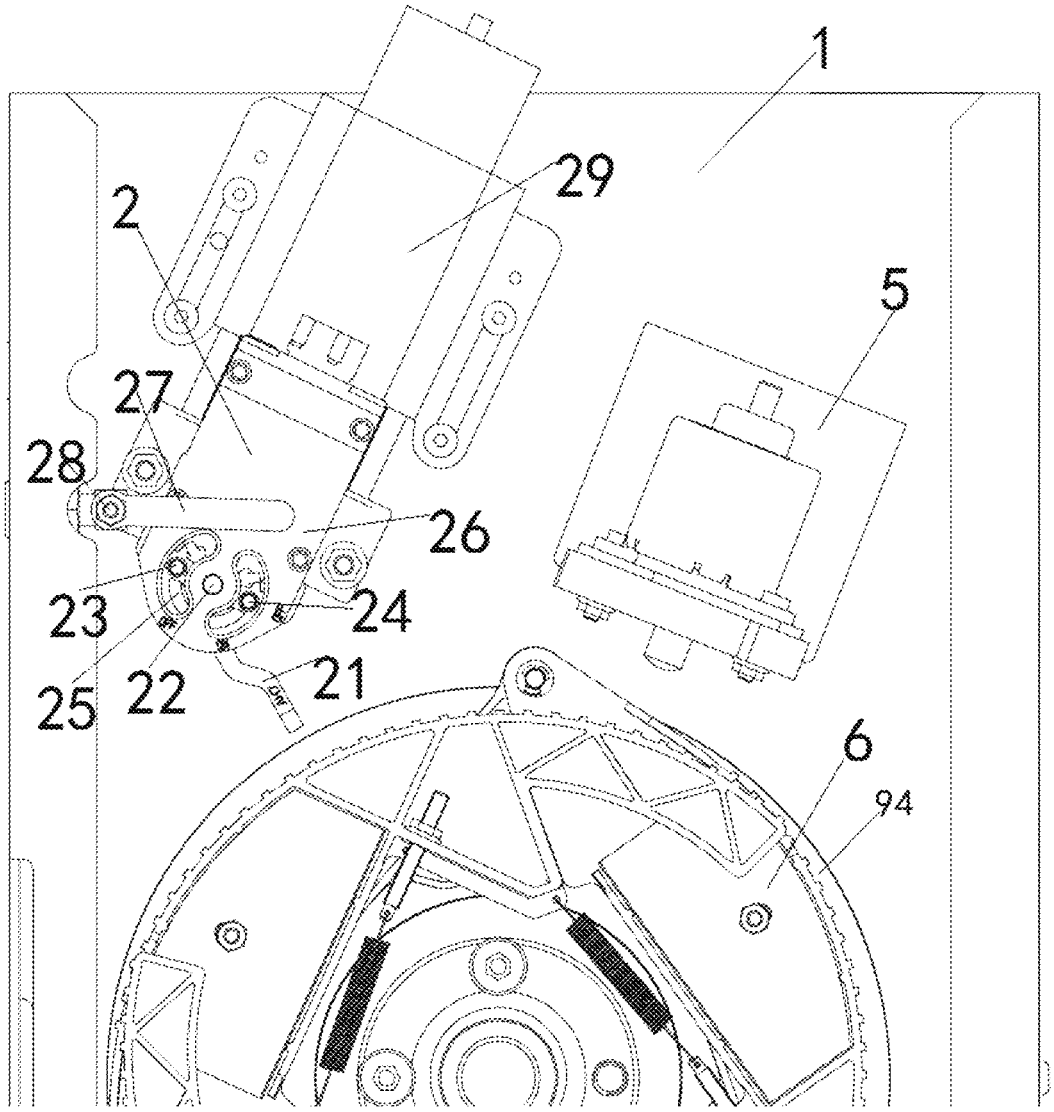
FIG. 2 illustrates a front view of an overspeed protection switch according to an embodiment of the present disclosure when in an untriggered position.

With continued reference to FIG. 2, an overspeed governor assembly according to an embodiment of the present disclosure and an overspeed protection switch therein are illustrated. The overspeed governor assembly includes: a rope sheave 94; a centrifugal mechanism 6 mounted on the rope sheave 94 and rotating with the rope sheave 94; and an overspeed protection switch 2 radially outward of the centrifugal mechanism 6 by a certain distance. In addition, the overspeed governor assembly also includes a remote trigger device 5. When the rope sheave 94 rotates with the rope and exceeds a predetermined speed, the centrifugal mechanism 6 will be gradually deployed and toggle a trigger member 21 of the overspeed protection switch 2, thereby braking and halting the elevator. The overspeed protection switch according to the present disclosure includes a trigger member 21. The trigger member 21 is in an untriggered position shown in FIG. 2 when the overspeed governor assembly is in normal operation, and the trigger member 21 is capable of rotating to a triggered position shown in FIG. 3 from the untriggered position when being toggled by the centrifugal mechanism 6 of the overspeed governor assembly in case of overspeed of the overspeed governor assembly. After the maintenance of the halted elevator, the trigger member 21 needs to be returned to the untriggered position. Therefore, the present disclosure provides the following reset device which includes: at least one protrusion 23, 24, a reset lever 27 and an actuation device. The at least one protrusion 23, 24 are connected with the trigger member 21 and rotate with the trigger member 21. In some embodiments, the at least one protrusion 23, 24 are located on a rotating frame 25, and the trigger member 21 extends from the rotating frame 25. The rotating frame 25 is rotatable along a shaft 22, the rotating frame 25 is accommodated in a housing 26, and at least one protrusion protruding from a front side of the housing 26 and is movable along a track defined by the housing 26. On the other hand, the trigger member 21 protrudes from a side of the housing 26. In some embodiments, the at least one protrusion 23, 24 includes a first protrusion 23 and a second protrusion 24 which are arranged in diametrically opposite positions of the rotating frame 25 (in other words, positions on a straight line passing through the axis of rotation and symmetrical with respect to the axis of rotation). On the other hand, the reset lever 27 can be driven by the actuation device to rotate from an idle position shown in FIG. 2 along an axial axis 28 to act on one of the at least one protrusion 23, 24, thereby causing the trigger member 21 to return to the untriggered position from the triggered position. In the idle position shown in FIG. 2, the reset lever is separated from the at least one protrusion 23, 24. On the other hand, the actuation device 29 may drive the reset lever 27 to rotate in response to a reset command (such as a command issued by an operator).

In some embodiments, when in the untriggered position shown in FIG. 2, the trigger member 21 is capable of rotating to a first triggered position (shown in FIG. 3) in a first direction or rotating to a second triggered position (shown in FIG. 6) in a second direction, depending on a rotational direction of the centrifugal mechanism 6. In some embodiments, the at least one protrusion 23, 24 includes a first protrusion 23 and a second protrusion 24, wherein in the first triggered position, the reset lever 27 contacts the first protrusion 23 and drives the trigger member 21 to return to the untriggered position from the first triggered position, and in the second triggered position, the reset lever 27 contacts the second protrusion 24 and drives the trigger member 21 to return to the untriggered position from the second triggered position.

Figure 3:
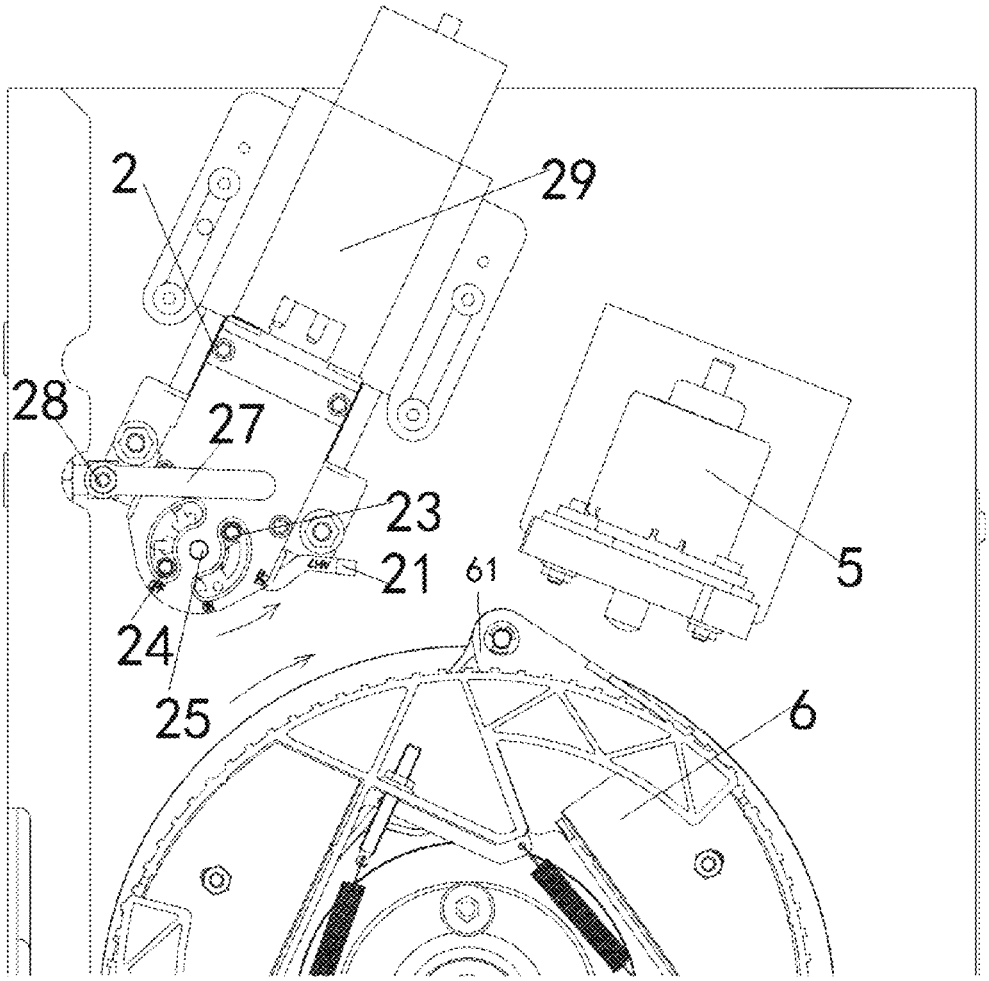
FIGS. 3 to 7 are front views of the overspeed protection switch according to the embodiment of the present disclosure in various states.
Figure 4:
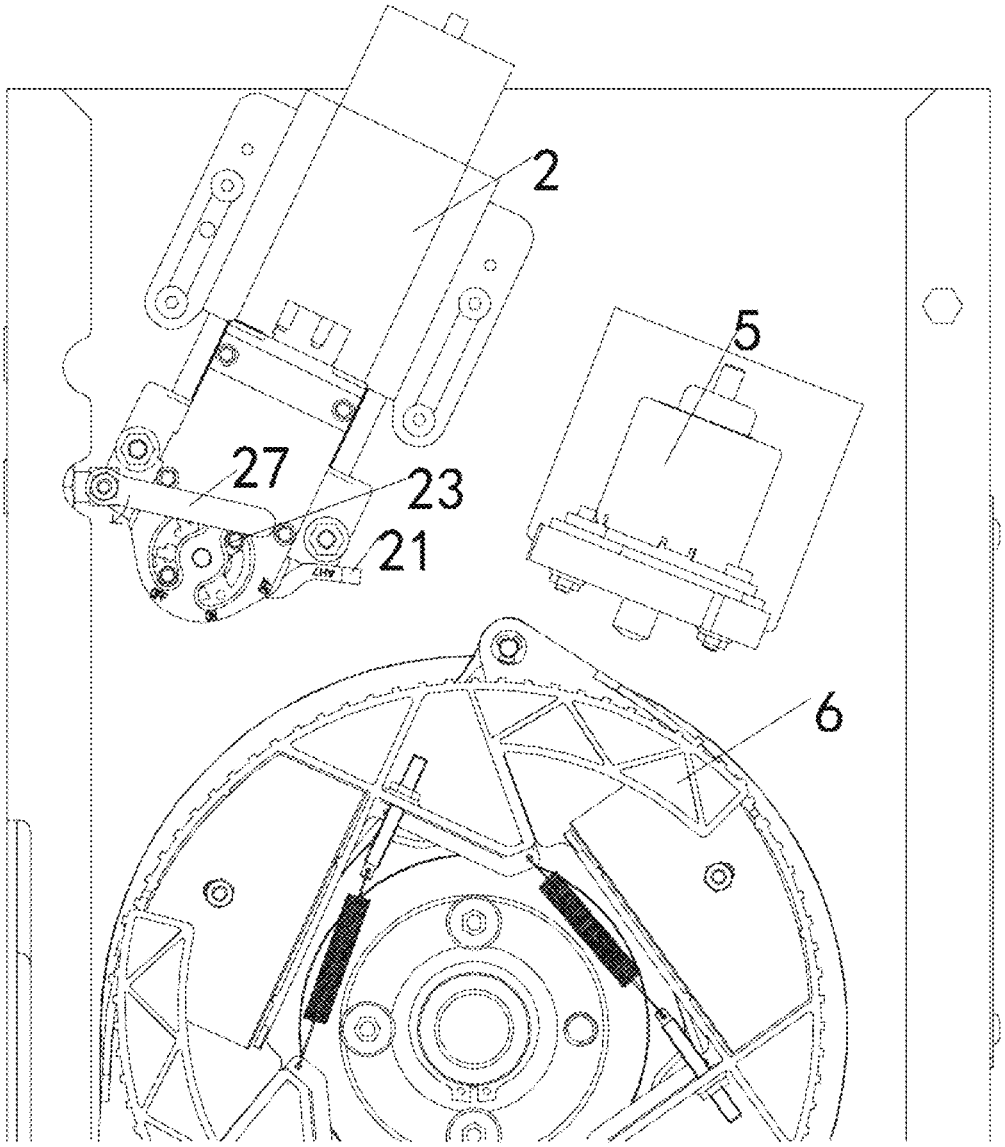
Figure 5:
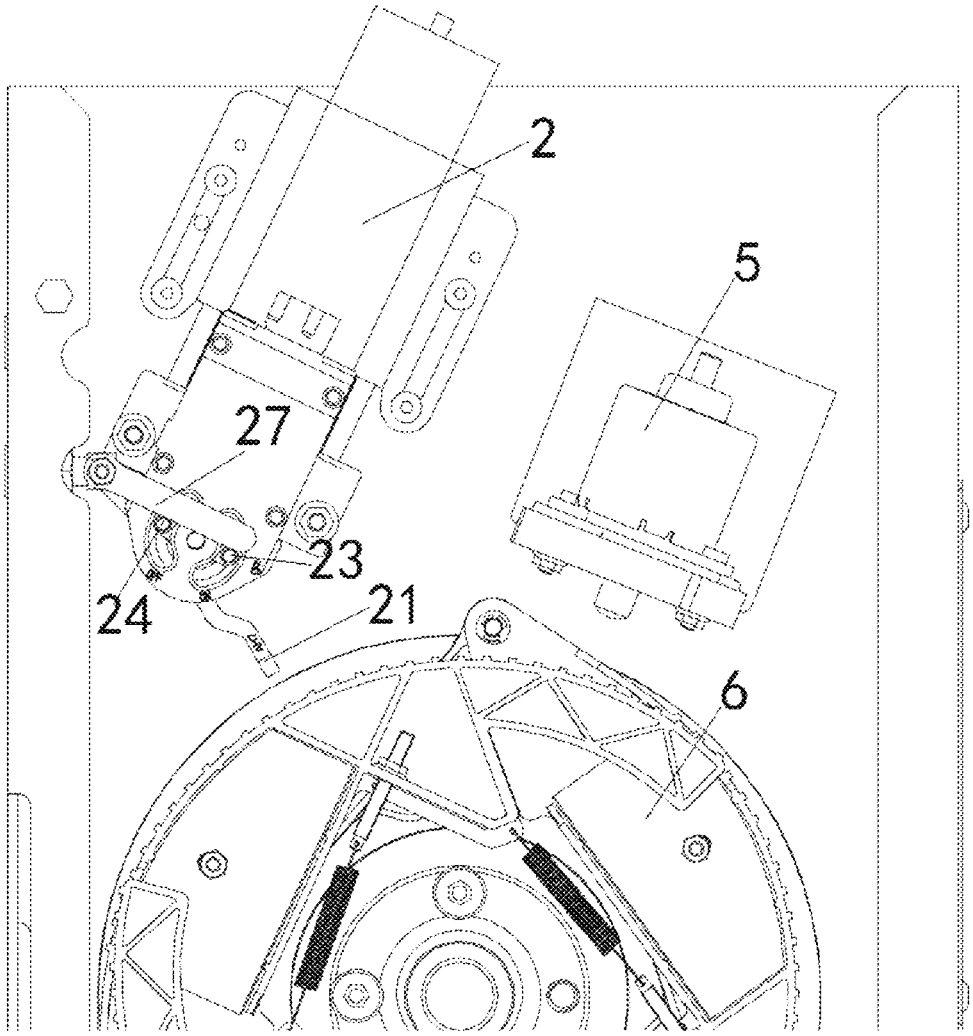

For example, reference is made to FIG. 2 to FIG. 5. In FIG. 2, the trigger member 21 of the overspeed protection switch 2 is in the untriggered position. Referring to FIG. 3, after the rope sheave rotates in the clockwise direction (for example, corresponding to the descending direction of the elevator) in the drawing and exceeds a predetermined speed, the centrifugal mechanism 6 is deployed, and a protrusion 61 thereon contacts and toggles the trigger member 21 in a first direction indicated by the arrow to the first triggered position shown in FIG. 3, thereby braking and halting the elevator. As the trigger member 21 rotates, the first protrusion 23 and the second protrusion 24 also rotate along a track defined by the housing 26 to the position shown in FIG. 3. After the maintenance of the halted elevator, the trigger member 21 needs to be reset, that is, the trigger member 21 has to return from the first triggered position to the untriggered position. As shown in FIG. 4, at this point, the reset lever 27 is rotated clockwise by the actuation device to contact the first protrusion 23, and the first protrusion 23 and the trigger member 21 are pushed to rotate back to the untriggered position as shown in FIG. 5. In some embodiments, as shown in FIG. 5, the reset lever 27 can simultaneously contact the first protrusion 23 and the second protrusion 24 when the trigger member 21 returns to the untriggered position. Subsequently, in some embodiments, when it is sensed that the trigger member 21 has returned to the untriggered position (e.g., it is sensed that the reset lever 27 contacts both the first protrusion 23 and the second protrusion 24, and the first protrusion 23 cannot be further pushed to rotate), the reset lever 27 is rotated counterclockwise to return to the idle position shown in FIG. 2.

Figure 6:
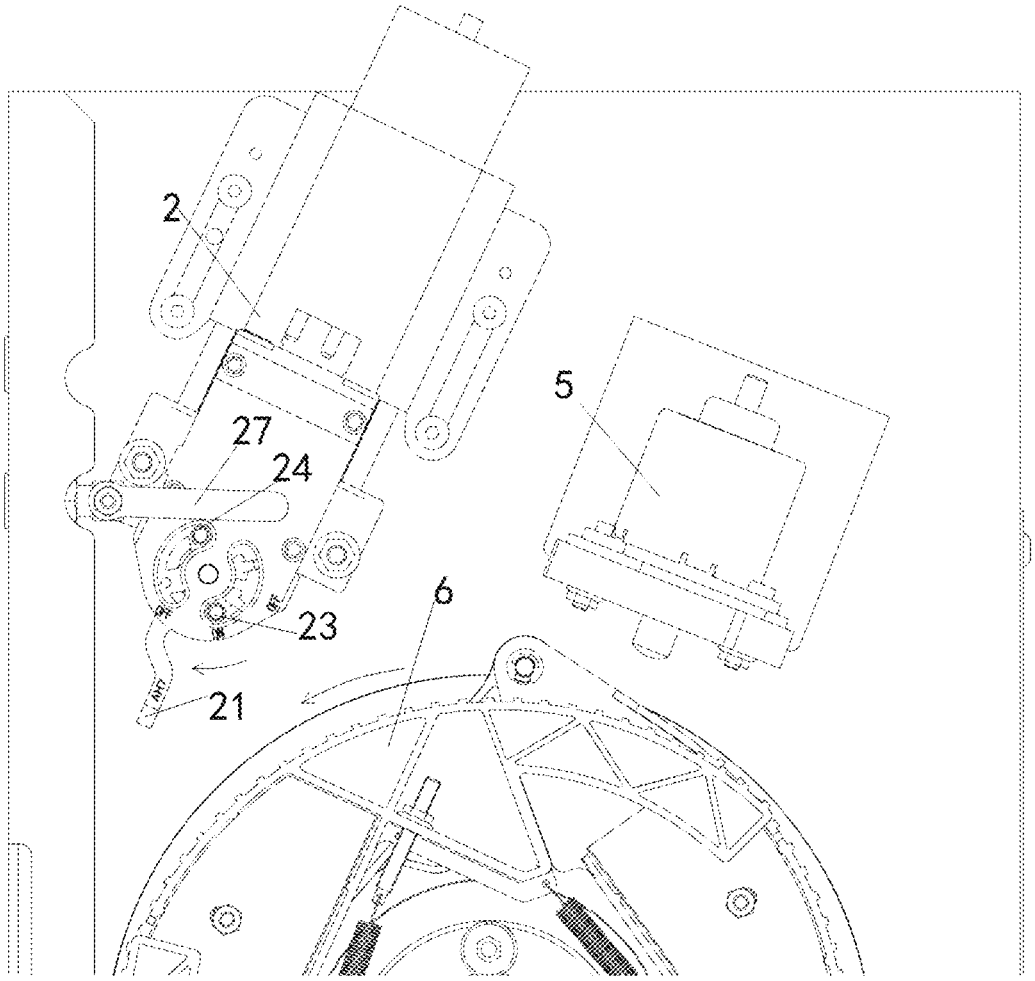
Figure 7:
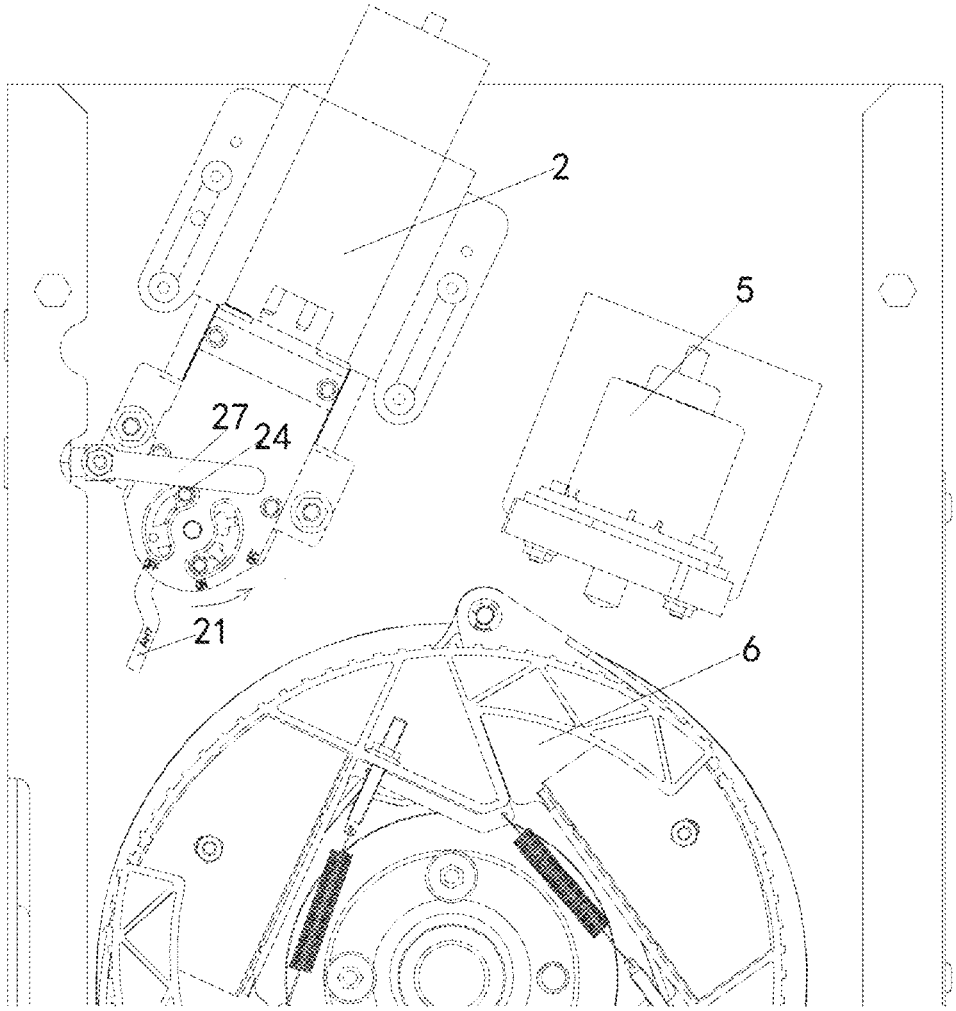

Another condition of the overspeed protection switch according to the present disclosure will be described with reference to FIGS. 2, 6, and 7. In FIG. 2, the trigger member 21 of the overspeed protection switch 2 is in the untriggered position. Referring to FIG. 6, after the rope sheave rotates in the counterclockwise direction (for example, corresponding to the ascending direction of the elevator) in the drawing and exceeds a predetermined speed, the centrifugal mechanism 6 is deployed, and the protrusion thereon contacts and toggles the trigger member 21 in a second direction indicated by the arrow to the second triggered position shown in FIG. 6, thereby braking and halting the elevator. As the trigger member 21 rotates, the first protrusion 23 and the second protrusion 24 also rotate along the track defined by the housing 26 to the position shown in FIG. 6. After the maintenance of the halted elevator, the trigger member 21 needs to be reset, that is, the trigger member 21 has to return from the second triggered position to the untriggered position. As shown in FIG. 7, at this point, the reset lever 27 is rotated clockwise by the actuation device to contact the second protrusion 24, and the second protrusion 24 and the trigger member 21 are pushed to rotate back to the untriggered position as shown in FIG. 5. Subsequently, in some embodiments, the reset lever 27 is rotated counterclockwise to return to the idle position shown in FIG. 2.

Figure 8:
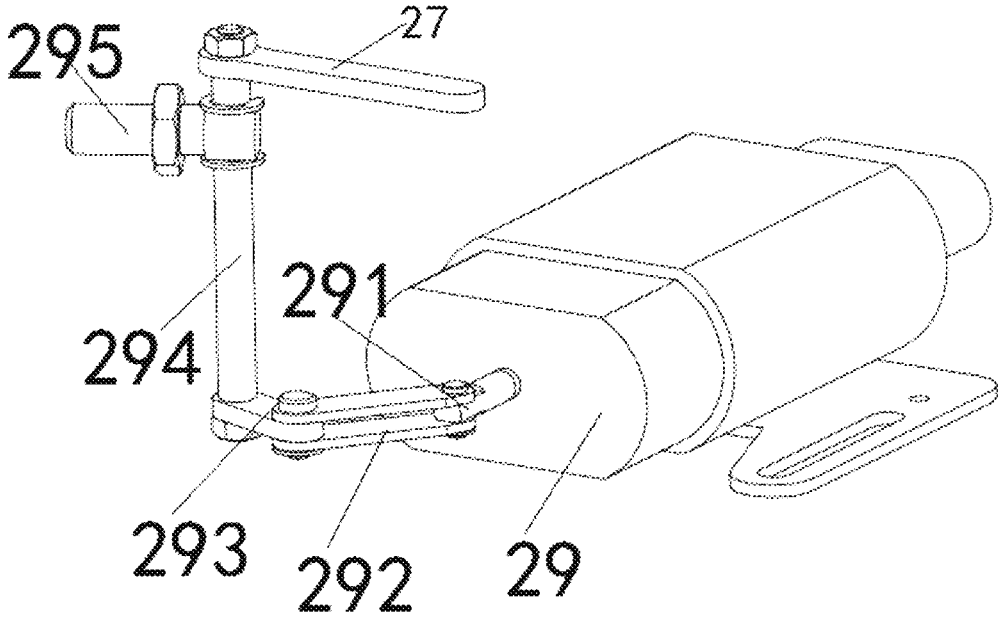
FIGS. 8 and 9 respectively show a perspective view and an exploded view of an actuation device and a reset lever according to an embodiment of the present disclosure.
Figure 9:
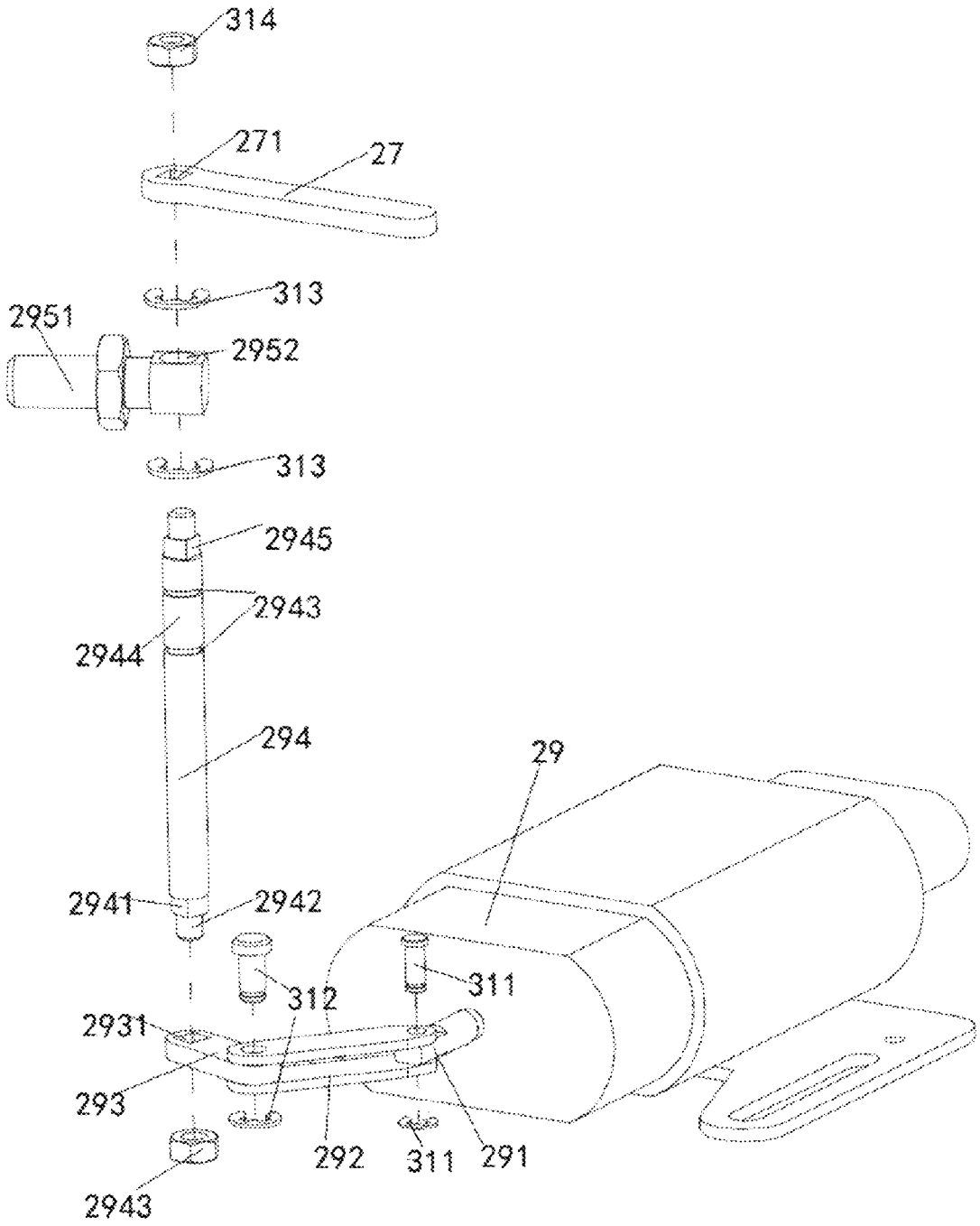

A detailed structure of the actuation device for rotating the reset lever 27 will be described in detail with reference to FIGS. 8 to 10. In some embodiments, the actuation device may be any suitable structure that drives a pivot shaft 28 to rotate, such as a motor or the like. In some embodiments, as shown in FIGS. 8 and 9, the actuation device includes: an actuator 29 having an action end 291 that is capable of performing a linear reciprocating movement; a link mechanism 292, 293, via which the actuator 29 is connected to a pivot shaft 294; and the pivot shaft 294 connected to the reset lever 27, wherein the pivot shaft 294 rotates when driven by the actuator 29. In some embodiments, the actuator 29 may be an electromagnet. In some embodiments, the link mechanism includes a first link 292, a first end of the first link 292 being pivotally connected to the action end 291 of the actuator 29, such as by a pin-and-buckle 311, and a second end of the first link 292 being pivotally connected to a first end of a second link 293, such as by a pin-and-buckle 312; and the second link 293, a second end of the second link 293 being drivingly connected to the pivot shaft 294 (i.e., connected in such a way of capable of transmitting a rotational movement). For example, the second end of the second link 293 is provided with a square hole (or another hole having a shape capable of transmitting a rotational movement) to be fitted with a square cross-section portion 2941 of the pivot shaft 294, which is achieved by the engagement of a bolt 2943 with a threaded portion 2942 of the pivot shaft 294. It can be seen that after the connection, the first link 292 is pivotally connected with the second link 293 and pivotally connected with the action end 291 of the actuator, and the second link 293 is drivingly connected with the pivot shaft 294; that is, as the second lever 293 rotates around the axis defined by the pivot shaft 294, the pivot shaft 294 will also rotate. On the other hand, in some embodiments, the pivot shaft 294 may also be fitted into a mounting hole 2952 of a limiting member 295 which is connected to a fixed bracket 1. For example, the fixed bracket 1 may include a base surface 11 and side walls on both sides, and the limiting member 295 may be formed into a cylindrical shape. The limiting member 295 includes a threaded portion 2951 to pass through the side wall 12 of the fixed bracket 1 and to be received by a nut, and the limiting member further includes the mounting hole 2952 to receive and position the pivot shaft 294. In addition, a buckle 313 may be used to axially position the pivot shaft relative to the limiting member 295. On the other hand, the reset lever 27 is drivingly connected to the other end of the pivot shaft 294. For example, the reset lever 27 may have a square hole (or another hole having a shape suitable for transmitting a rotational movement), and the other end of the pivot shaft 294 includes a square cross-section portion 2945. In addition, a nut 314 is fitted to the pivot shaft 294 to axially position the reset lever 27. In an alternative embodiment, the pivot shaft can be rotatably connected to the fixed bracket 1 in other ways; for example, the pivot shaft 294 may have an extension passing through the base surface 11 of the fixed bracket 1.

Figure 10:
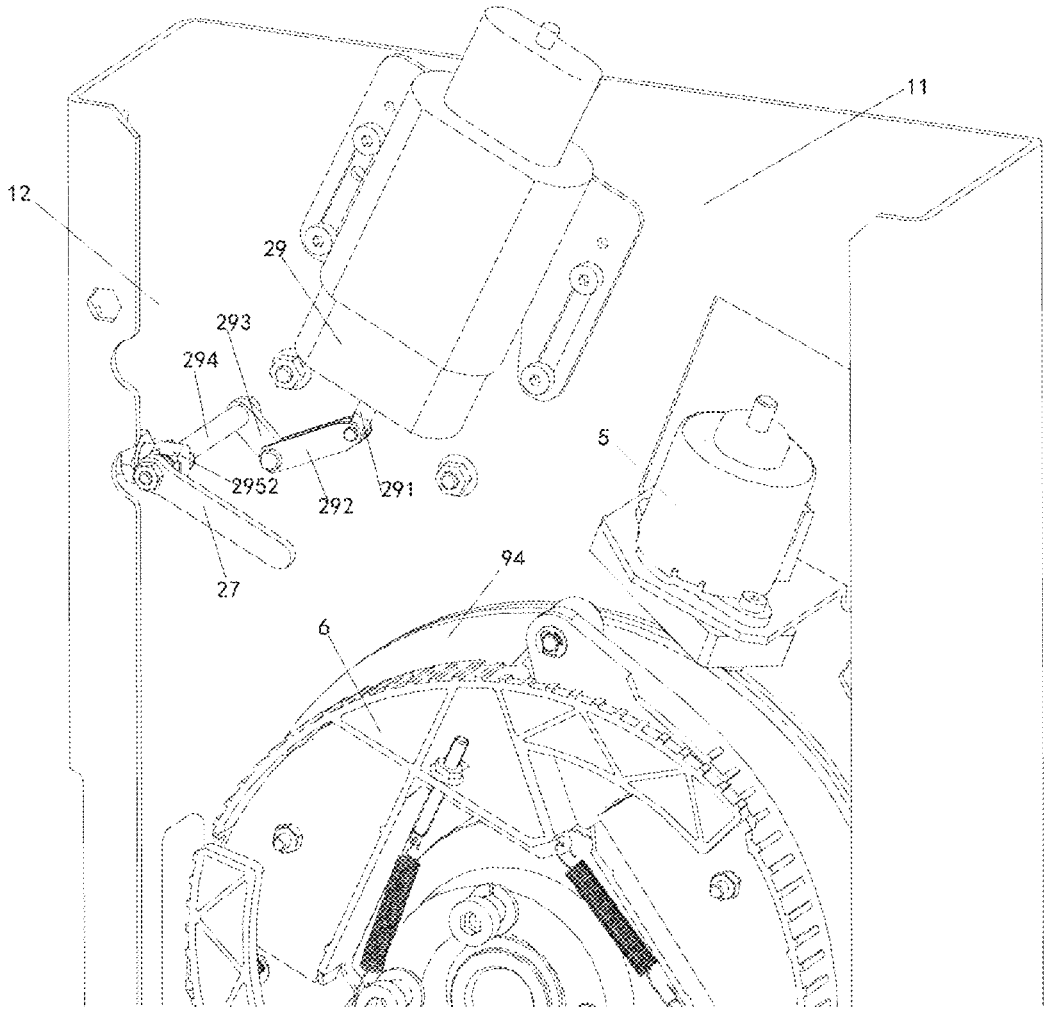
FIG. 10 shows a perspective view of an overspeed governor assembly according to an embodiment of the present disclosure, with parts of the overspeed protection switch being removed.

Referring to FIG. 10, some of the components of the overspeed protection switch are removed such that the specific structure of the actuation device is visible. In the overspeed protection switch according to the embodiment of the present disclosure, the action end 291 of the actuator 29, the first link 292 and the second link 293 move in a first plane (closer to the base surface 11 of the fixed bracket), the reset lever 27 moves in a second plane, the pivot shaft 294 extends from the first plane to the second plane, the first plane is closer to the base surface of the fixed bracket than the second plane, and the first plane and the second plane are parallel with each other. In some embodiments, the trigger member 21 is located between the first plane and the second plane, and the at least one protrusion 23, 24 extends to the second plane such that the reset lever can act on the at least one protrusion 23, 24, thereby enabling the designed overspeed protection switch to have a more compact structure.

In another aspect, the present disclosure also aims to provide an elevator system including an overspeed governor assembly according to various embodiments of the present disclosure.

The overspeed protection switch according to embodiments of the present disclosure has a simple structure, is convenient to operate and has low cost. It can be used in combination with an existing electromagnet actuator, requires less thrust for the electromagnet and saves cost.

The specific embodiments described above are merely for describing the principle of the present disclosure more clearly, and various components are clearly illustrated or depicted to make it easier to understand the principle of the present disclosure. Those skilled in the art can readily make various modifications or changes to the present disclosure without departing from the scope of the present disclosure. It should be understood that these modifications or changes should be included within the scope of protection of the present disclosure.

What is claimed is:

1. An overspeed protection switch for an overspeed governor assembly, the overspeed protection switch comprising:

a trigger member, which is in an untriggered position when the overspeed governor assembly is in normal operation, and which is capable of rotating to a triggered position from the untriggered position when being toggled by a centrifugal mechanism of the overspeed governor assembly in case of overspeed of the overspeed governor assembly;

at least one protrusion connected to the trigger member and rotating together with the trigger member;

a reset lever which is rotatable along an axial from an idle position axis to act on one of the at least one protrusion to drive the trigger member to return to the untriggered position from the triggered position; and an actuation device which, in response to a reset command, acts on the reset lever to rotate the reset lever;

wherein the actuation device comprises:

an actuator having an action end capable of performing a linear reciprocating movement;

a link mechanism, via which the actuator is connected to a pivot shaft; and the pivot shaft connected to the reset lever, wherein the pivot shaft rotates when driven by the actuator so as to drive the reset lever to rotate.

2. The overspeed protection switch according to claim 1, wherein the pivot shaft is fitted into a mounting hole of a limiting member, and the limiting member is connected to a fixed bracket.

3. The overspeed protection switch according to claim 2, wherein the link mechanism comprises:

a first link, a first end of the first link being pivotally connected to the action end of the actuator, and a second end of the first link being pivotally connected to a first end of a second link; and the second link, a second end of the second link being drivingly connected to the pivot shaft.

4. The overspeed protection switch according to claim 3, wherein the action end of the actuator, the first link and the second link move in a first plane, the reset lever moves in a second plane, the pivot shaft extends from the first plane to the second plane, the first plane is closer to a base surface of the fixed bracket than the second plane, and the first plane and the second plane are parallel with each other.

5. The overspeed protection switch according to claim 4, wherein the trigger member is located between the first plane and the second plane, and the at least one protrusion extends to the second plane.

6. The overspeed protection switch according to claim 1, wherein when in the untriggered position, the trigger member is capable of rotating to a first triggered position in a first direction or rotating to a second triggered position in a second direction, depending on a rotational direction of the centrifugal mechanism.

7. The overspeed protection switch according to claim 6, wherein the at least one protrusion comprises a first protrusion and a second protrusion, wherein in the first triggered position, the reset lever contacts the first protrusion and drives the trigger member to return to the untriggered position from the first triggered position, and in the second triggered position, the reset lever contacts the second protrusion and drives the trigger member to return to the untriggered position from the second triggered position.

8. The overspeed protection switch according to claim 7, wherein the trigger member has an outer end and an inner end, the inner end of the trigger member is connected to a rotating frame, and the first protrusion and the second protrusion are arranged on the rotating frame.

9. The overspeed protection switch according to claim 7, wherein when the trigger member returns to the untriggered position, the reset lever contacts the first protrusion and the second protrusion simultaneously and after the trigger member returns to the untriggered position, the reset lever returns to the idle position.

10. An overspeed governor assembly, comprising:

a rope sheave;

a centrifugal mechanism mounted on the rope sheave and rotating together with the rope sheave; and an overspeed protection switch radially outward of the centrifugal mechanism by a certain distance, the overspeed protection switch comprising:

a trigger member, which is in an untriggered position when the overspeed governor assembly is in normal operation, and which is capable of rotating to a triggered position from the untriggered position when being toggled by the centrifugal mechanism of the overspeed governor assembly in case of overspeed of the overspeed governor assembly;

at least one protrusion connected to the trigger member and rotating together with the trigger member;

a reset lever which is rotatable along an axial axis from an idle position to act on one of the at least one protrusion to drive the trigger member to return to the untriggered position from the triggered position; and an actuation device which, in response to a reset command, acts on the reset lever to rotate the reset lever;

wherein the actuation device comprises:

an actuator having an action end capable of performing a linear reciprocating movement;

a link mechanism, via which the actuator is connected to a pivot shaft; and the pivot shaft connected to the reset lever, wherein the pivot shaft rotates when driven by the actuator so as to drive the reset lever to rotate.

11. The overspeed governor assembly according to claim 10, wherein the pivot shaft is fitted into a mounting hole of a limiting member, and the limiting member is connected to a fixed bracket.

12. The overspeed governor assembly according to claim 11, wherein the link mechanism comprises:

a first link, a first end of the first link being pivotally connected to the action end of the actuator, and a second end of the first link being pivotally connected to a first end of a second link; and the second link, a second end of the second link being drivingly connected to the pivot shaft.

13. The overspeed governor assembly according to claim 12, wherein the action end of the actuator, the first link and the second link move in a first plane, the reset lever moves in a second plane, the pivot shaft extends from the first plane to the second plane, the first plane is closer to a base surface of the fixed bracket than the second plane, and the first plane and the second plane are parallel with each other.

14. The overspeed governor assembly according to claim 13, wherein the trigger member is located between the first plane and the second plane, and the at least one protrusion extends to the second plane.

15. The overspeed governor assembly according to claim 10, wherein when in the untriggered position, the trigger member is capable of rotating to a first triggered position in a first direction or rotating to a second triggered position in a second direction, depending on a rotational direction of the centrifugal mechanism.

16. The overspeed governor assembly according to claim 15, wherein the at least one protrusion comprises a first protrusion and a second protrusion, wherein in the first triggered position, the reset lever contacts the first protrusion and drives the trigger member to return to the untriggered position from the first triggered position, and in the second triggered position, the reset lever contacts the second protrusion and drives the trigger member to return to the untriggered position from the second triggered position.

17. The overspeed governor assembly according to claim 16, wherein the trigger member has an outer end and an inner end, the inner end of the trigger member is connected to a rotating frame, and the first protrusion and the second protrusion are arranged on the rotating frame.

18. The overspeed governor assembly according to claim 17, wherein when the trigger member returns to the untriggered position, the reset lever contacts the first protrusion and the second protrusion simultaneously and after the trigger member returns to the untriggered position, the reset lever returns to the idle position.

19. The overspeed governor assembly according to claim 10, wherein the overspeed governor assembly is a car-mounted overspeed governor assembly.

20. An elevator system, comprising the overspeed governor assembly according to claim 10.

* * * * *